US006312118B1

(12) United States Patent
Lerat et al.

(10) Patent No.: US 6,312,118 B1
(45) Date of Patent: Nov. 6, 2001

(54) ATMOSPHERE CONTROL DEVICE FOR INK RESERVOIR APPLIED TO INK JET PRINTING

(75) Inventors: Yannick J. Lerat, Chalon sur Saone; Didier J. Martin, Givry; Olivier J. Poncelet, Chalon sur Saone; Thierry Vachette, Esbarres, all of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/595,525

(22) Filed: Jun. 16, 2000

(30) Foreign Application Priority Data

Jun. 21, 1999 (FR) ..... 99 08044

(51) Int. Cl.[7] ..... B41J 2/175
(52) U.S. Cl. ..... 347/86
(58) Field of Search ..... 347/85, 86, 87, 347/92, 35; 429/30

(56) References Cited

U.S. PATENT DOCUMENTS

| | | | | |
|---|---|---|---|---|
| 4,279,653 | | 7/1981 | Makishima et al. | 106/31.32 |
| 4,345,432 | | 8/1982 | Iida et al. | 60/290 |
| 4,489,334 | | 12/1984 | Owatari | 347/92 |
| 5,227,257 | | 7/1993 | Abraham et al. | 429/30 |
| 5,500,663 | * | 3/1996 | Ujita et al. | 347/86 |
| 5,759,712 | | 6/1998 | Hockaday | 429/30 |
| 5,812,155 | | 9/1998 | Seccombe | 347/6 |
| 5,992,008 | | 11/1999 | Kindler | 29/730 |

FOREIGN PATENT DOCUMENTS

| | | | |
|---|---|---|---|
| 0 204 872 A1 | | 12/1986 | (EP) . |
| 1 063 091-A1 | * | 12/2000 | (EP) . |
| 56 24472 | | 3/1981 | (JP) . |
| 56 41275 | | 4/1981 | (JP) . |
| 03 104651 | | 5/1991 | (JP) . |
| 07 276632 | | 10/1995 | (JP) . |
| WO 90/15323 | | 12/1990 | (WO) . |
| WO 96/32284 | | 10/1996 | (WO) . |

OTHER PUBLICATIONS

Harry J. Spinelli, "Polymeric Dispersants in Ink Jet Technology" in Advanced Materials, 1998, 10, No. 15, pp. 1215–1218.

C. Sant and J.P. Contour, "Pulsed Laser Deposition of $Bi_4Cu_{2x}V_{2(1-x)}O_{11}$ Thin Films" in Journal of Crystal Growth, Jan. 4, 1995, pp. 63–67.

* cited by examiner

*Primary Examiner*—N. Le
*Assistant Examiner*—Michael Nghiem
(74) *Attorney, Agent, or Firm*—Milton S. Sales

(57) ABSTRACT

The invention relates to an ink reservoir for ink jet printing. This reservoir includes a solid electrolyte pellet inserted in the wall of the reservoir, which conducts $O^{2-}$ ions when subjected to an electric current. The reservoir allows to control the internal atmosphere of the reservoir above the free surface of the ink that it contains.

7 Claims, 1 Drawing Sheet

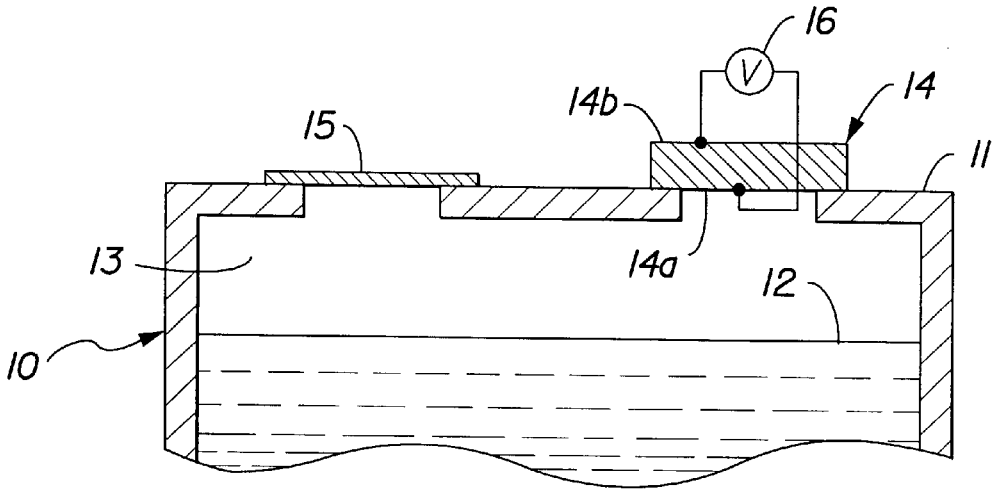
16
V
14b
14
15
11
13
14a
12
10

ATMOSPHERE CONTROL DEVICE FOR INK RESERVOIR APPLIED TO INK JET PRINTING

FIELD OF THE INVENTION

This invention relates to ink jet printing, and more particularly to an atmosphere control device for an ink jet printer.

BACKGROUND OF THE INVENTION

In ink jet printing technology, the main concerns are to improve the quality as well as the speed of printing.

Printing technologies developed today almost all have the objective of producing high quality copies as fast as possible. In the case of ink jet technologies, to achieve fast printing, the various manufacturers multiply, on the surface of the heads, the number of nozzles that are capable of ejecting ink drops in order to print a greater number of points in parallel on the receiving medium.

One technology for making ink jet printing heads consists in forming and ejecting ink drops by the action of a pressure wave created by the pulsation of a piezoelectric ceramic.

Another conventional technology for making ink jet heads consists in raising to a high temperature, typically 300 to 400° C., the ink located in a channel for a very short time. This induces local vaporization of the ink which expulses that liquid part of the ink located between the vaporization zone and the surface of the ink jet head in the form of a drop. This method requires thermal energy within the volume of the ink jet head itself, which then has to be dissipated.

Another technique, for example as described in patent application WO96/32284, consist in bringing a fluid into contact with a ring shaped heating element located at the periphery of the aperture of a channel linking a reservoir containing fluid with the aperture at the surface of the ink jet head. Pressure is applied to the reservoir in order to enable the ink to be conveyed through the channel and to be spread on the ring shaped heating surface of the ink jet head. When the heating element of the ink jet head is raised to a temperature of about 130° C., a significant modification takes place to the surface tension of the ink drop located in contact with the heating element. This surface tension modification causes a reduction in the radius of curvature of the meniscus of the ink drop thus enabling it to flow freely through the channel and to form a drop of suitable size for the printing required. Once formed, this drop is then ejected by a means which may be an electrostatic field between the ink jet head and the printing medium, for example a sheet of paper. This technique, which has the advantage of considerably lowering the temperature necessary to eject a unit volume of ink, is thus appropriate for the manufacture of highly integrated ink jet heads.

Ink jet printing heads are capable of delivering several thousand ink drops with a unit volume of some picoliters per second. These heads have increasingly small dimensions. They are produced by micro-engineering or micro-manufacturing techniques. With such devices, the control of the ink quality becomes a critical factor. In fact, variations in ink properties can affect the operation of the heads, for example by gumming them up, and the printing quality. The inks are complex mixtures, in the form of dispersions, of emulsions or solutions of dyes or pigments in solvents, in water based or mixed media. These mixtures contain many additives such as antifoaming agents, agents for facilitating grinding, surfactants, biocides, buffers, thickeners. These mixtures, to be suitable for ink jet printing, must have a set of characteristics which are: pen reliability, i.e. resistance to polymerization, stability to oxidation or the action of bacteria, and ejection capability, i.e. the capacity to form drops that can be ejected by the printing head. These characteristics are described by H. J. Spinelli in Advanced Materials, 10, No 15, pages 1215–1218 (1998). Thus, the inks and the dyes they contain are sensitive to air oxidation. This oxidation modifies the ink properties, and thus the process of forming drops and affects the printing performance. According to the prior art, attempts to remedy ink instability to oxidation have been made by adding to these inks antioxidants such as dithionous acid, sodium sulfite, pyrogallol, sulfites or ascorbic acid, as is described in U.S. Pat. Nos. 4,489,334 or 4,279,653, or in Japanese Patent Applications 79/98690 or 79/116710. However, the action of these antioxidants remains limited and it complicates the ink manufacturing process. It is also known that the presence of air bubbles in the ink disturbs both the ink flow rate to the printing head and the formation of ink drops. Thus, it is desirable to control the atmosphere in ink reservoirs to prevent bubbles forming and then being conveyed in the printer channels to the printing head. It can also happen that air enters when the ink reservoir or printer is filled, or when the ink cartridge is changed, if interchangeable cartridges are used. According to the prior art, attempts have been made to remedy this problem by equipping ink reservoirs or printer cartridges with valves to prevent the introduction of air in the ink circuit to the print heads, as is described in U.S. Pat. No. 5,812,155. The utilization of these valves introduces an undesirable complexity into the technology of ink jet printers and associated reservoirs.

SUMMARY OF THE INVENTION

One of the objects of the invention is to provide a device that improves the control of the ink quality for ink jet printing.

This object is achieved with the present invention that relates to a device for the control of the atmosphere of an ink reservoir intended for ink jet printing; this device comprising electrical contacts or electrodes, and a solid electrolyte that conducts $O_{2-}$ ions when subjected electric current and heat such that an electric field is established in the solid electrolyte.

The present invention also relates to an ink reservoir for an ink jet printer, said ink reservoir comprising a device for controlling the ink quality comprising a solid electrolyte that conducts $O^{2-}$ ions when subjected to electric current and heat.

The invention also relates to a process for controlling the ink quality in a reservoir of an ink jet printer, this process comprising the utilization of a solid electrolyte whose $O^{2-}$ ion conducting properties can be selected under the action of electric current and heat to transport the oxygen present in the proximity of this solid electrolyte.

BRIEF DESCRIPTION OF THE DRAWINGS

The FIGURE is a schematic partially shown view of an ink reservoir useful for ink jet printing and showing the means for controlling the atmosphere according to the invention.

DESCRIPTION OF THE PREFERRED EMBODIMENTS

The device according to the invention is applicable to an ink reservoir for an ink jet printer, and comprises a solid electrolyte having $O^{2-}$ ion conducting properties when subjected to electric current and heat and an electrode adapted to selectively apply electric field to the electrolyte. This solid electrolyte is in contact both with the internal atmosphere of the reservoir and the atmosphere external to the reservoir.

When the solid electrolyte is energized and heated, as described below, the oxygen present in the reservoir is absorbed into the solid electrolyte and transported to the exterior of the reservoir.

The electrolyte used according to the invention is in particular described in the U.S. Pat. No. 5,227,257. This electrolyte is a substance derived from $Bi_4V_2O_{11}$ comprising a gamma phase structure and whose Bi and/or V elements have been replaced by substitution elements to enable the conductivity of $O^{2-}$ ions without altering the gamma phase. This solid electrolyte has the formula:

$$(Bi_{2-x}M_xO_2)(V_{1-y}M'_yO_z)$$

where,

M represents one or more Bi substitution metals, having an oxidation number less than or equal to 3, M' represents one or more V substitution elements, selected from the class constituted by the alkaline metals, alkaline-earth metals, transition metals, group IIIa to Va metals, group IIIb to Vb metals, and rare earths;

the limit values of x, y, x being a function of the nature of M and M'; and x plus y is greater than zero.

A solid electrolyte according to the invention may be used in the following way with reference to the Figure. A pellet is made with this solid electrolyte (14) which is inserted into the wall (11) of the ink reservoir (10) filled with ink (12) so that one of the pellet faces **(14*a*) is in contact with the internal atmosphere of the reservoir, while the other face (14*b*) is in contact with the atmosphere external to this reservoir. The pellet is connected to a current source 16 and heated by a heating means not shown to a temperature less than 500° C. and preferably between 150 and 500° C., the temperature at which the solid electrolyte becomes conductive. When the solid electrolyte becomes conductive, and a potential difference is applied to it, each main face (14*a*) and (14*b*) of the pellet (14) behaves as an electrode. The oxygen molecule dissociates at the surface of the cathode forming $O^{2-}$ ions which cross the solid electrolyte and recombine into an oxygen molecule when they come to the other face which behaves as an anode. If the polarity is such that the internal face (14*a*) of the pellet behaves as a cathode and the external face (14*b*)** as an anode, the oxygen will migrate from the inside to the exterior of the reservoir. According to the present invention, the polarity applied to the solid electrolyte must enable, on the face of this electrolyte which is in the presence of or near to the ink, the atmosphere near to the ink to be depleted of oxygen. The following explanation can be given to understand the functioning of the device according to the invention, even though this explanation should not limit the scope of the invention. It is thought that there is dissociation of the oxygen molecules at the cathode of the solid electrolyte:

$$O_2+4_{e-}\rightarrow 2O^{2-},$$

and then migration of the ions within the solid electrolyte in the direction of the electric field, and then recombination of the $O^{2-}$ ions at the anode of the solid electrolyte. For this recombination, two ions and four electrons must be transferred:

$$2O^{2-}\rightarrow 4_{e-}+O_2$$

These solid electrolytes, as described in U.S. Pat. No. 5,227,257, are designated under the generic name of Bimevox, or according to the metal associated with the Bismuth, under the names, Bicuvox, Bicovox, Biznvox, etc.

An element based on Bimevox as described in the Patent cited above comprises a solid electrolyte pellet each of whose faces is in contact with electrical contacts themselves linked to an electrical current source.

The solid electrolyte/electrical contacts assembly is associated with a heating means enabling the solid electrolyte to be operated at the required temperature. This temperature is between 150 and 500° C. This operating temperature enables dissipation of the heat produced using the usual techniques.

According to one embodiment, a Bimevox pellet is made by compacting, in which are inserted two metal grids flush with each face of the pellet and acting as electrical contacts. According to a preferred embodiment, these grids are made with a noble metal conductor such as gold. Such a solid electrolyte can operate below 500° C., with a voltage of 1 to 30 V, advantageously 1 to 15 V, and with a current density from 100 to 1500 mA/cm$^2$, for example at 2 V.

Bimevox type solid electrolytes can be made in the form of thin layers arranged on appropriate substrates, for example Magnesium oxide, Beryllium, Titanium or Strontium oxide, as is described by C. Sant et al in Journal of Crystal Growth, 153, 1995, p. 63–67 "Pulsed Laser Deposition of $Bi_4Cu_2xV_{2(1-x)}O_{11}$ Thin Films". These thin film deposits can be produced by pulsed laser.

According to one embodiment of the present invention, the solid electrolyte can be used in the following way in the case of an ink not sensitive to oxidation, still with reference to the Figure. The solid electrolyte (14) is polarized so that the face **(14*a*) acts as anode and the face (14*b*) acts as cathode. In this configuration, oxygen is introduced into the reservoir atmosphere (13). By opening the valve (15), the oxygen passes out which draws off the gas dissolved in the ink. Then the system is closed, and the polarity of the solid electrolyte (14)** is reversed, which can then pump the oxygen out of the reservoir. This system can be servo controlled and programmed to operate automatically in cycles measured according to the volume of atmosphere above the free ink surface. In fact, the volume increases as the reservoir empties. This control method for the ink reservoir atmosphere makes it possible to control the refilling of ink reservoirs or cartridges. An ink can be "composed" specifically to undergo the degassing mentioned above and thus resist oxidation in the presence of an oxygen enriched atmosphere (up to 95%). Then it will be difficult or even impossible to refill a used cartridge with an oxidizable ink that does not withstand such an environment.

The reservoir according to the invention can comprise means for refilling the reservoir. The filling means, the value and the solid electrolyte can be operated so that the reservoir is filled without excess and without air bubbles being introduced.

The invention has been described in detail with particular reference to certain preferred embodiments thereof, but it will be understood that variations and modifications can be effected within the spirit and scope of the invention.

PART LIST

10 ink reservoir

11 wall of the ink reservoir

12 ink

13 atmosphere above the ink surface

14 pellet of solid electrolyte

14*a* face of the pellet in contact with the atmosphere of the reservoir

14*b* face of the pellet in contact with the atmosphere outside the reservoir

15 valve

What is claimed is:

1. An ink reservoir for an ink jet printer comprising a device for controlling the reservoir atmosphere, this device comprising (i) a solid electrolyte having the properties of conducting $O^{2-}$ ions when subjected to an electric current and heat, and (ii) an electrode adapted to selectively apply electric field to the electrolyte, wherein polarity applied to the solid electrolyte is such that one part of the solid electrolyte, in contact with the inside of the reservoir, acts as a cathode and another part of the solid electrolyte in contact with the atmosphere external to the reservoir, acts as an anode, such that the oxygen present in the reservoir is absorbed into the solid electrolyte and transported to the exterior of the reservoir.

2. The ink reservoir of claim 1, wherein the solid electrolyte is a pellet having two main faces inserted into a wall of the container so that one of the main faces of the solid electrolyte pellet is in contact with the atmosphere inside the container and the other main face is in contact with the atmosphere external to the reservoir.

3. The reservoir of claim 2, wherein further the polarity of the solid electrolyte can be changed in a preset way so that the part of the solid electrolyte, in contact with the inside of the reservoir, acts as an anode and the other part of the solid electrolyte in contact with the atmosphere external to the reservoir, acts as a cathode such that oxygen is introduced into the reservoir atmosphere, and further comprising an aperture to the external atmosphere, equipped with a valve, so that introduced oxygen can pass out by opening the valve.

4. The reservoir of claim 3, further comprising filling means to refill the container with the printing ink.

5. The reservoir of claim 4, wherein the filling means, valve, and solid electrolyte operate together to enable the reservoir to be filled without excess and without air bubbles being introduced.

6. A process for degassing an ink reservoir for ink jet printing as set forth in claim 3 comprising the steps of:

(i) polarizing the solid electrolyte so that the part of the solid electrolyte, in contact with the inside of the reservoir, acts as an anode and the other part of the solid electrolyte in contact with the atmosphere external to the reservoir, acts as a cathode such that oxygen is introduced into the reservoir atmosphere, (ii) opening the valve so that introduced oxygen passes out and draws off the gas dissolved in the ink, (iii) closing the reservoir, and (iv) reversing the polarity of the solid electrolyte, so that the oxygen present in the reservoir is absorbed into the solid electrolyte and transported to the exterior of the reservoir.

7. The reservoir of claim 1, wherein the solid electrolyte comprises a derivative of $Bi_4V_2O_{11}$ in the gamma phase where at least one of the elements Bi or V is replaced at least in part by another element so that the gamma phase structure of $Bi_4V_2O_{11}$ is maintained as well as the balance of the charges.

* * * * *